US008811838B2

(12) United States Patent
Yamada

(10) Patent No.: US 8,811,838 B2
(45) Date of Patent: Aug. 19, 2014

(54) FIXING DEVICE AND IMAGE FORMING APPARATUS INCORPORATING SAME

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 363 days.

(21) Appl. No.: 13/398,916

(22) Filed: Feb. 17, 2012

(65) Prior Publication Data

US 2012/0224869 A1 Sep. 6, 2012

(30) Foreign Application Priority Data

Mar. 4, 2011 (JP) ..... 2011-047509

(51) Int. Cl.
*G03G 15/20* (2006.01)
*G03G 21/20* (2006.01)

(52) U.S. Cl.
CPC ..... *G03G 15/2078* (2013.01); *G03G 15/2064* (2013.01)
USPC ..... 399/33; 399/92

(58) Field of Classification Search
USPC ..... 399/33, 92
See application file for complete search history.

(56) References Cited

U.S. PATENT DOCUMENTS

| | | | | |
|---|---|---|---|---|
| 5,210,580 | A * | 5/1993 | Aslam et al. | 399/328 |
| 5,956,554 | A | 9/1999 | Yanashima et al. | |
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,865,363 | B2 | 3/2005 | Hachisuka et al. | |
| 6,925,280 | B2 | 8/2005 | Yamada | |
| 7,228,096 | B2 | 6/2007 | Yamada | |
| 7,359,664 | B2 | 4/2008 | Yamada | |
| 7,751,768 | B2 | 7/2010 | Yamada | |
| 7,890,039 | B2 | 2/2011 | Yamada | |
| 2001/0003562 | A1 | 6/2001 | Hachisuka et al. | |

(Continued)

FOREIGN PATENT DOCUMENTS

| | | |
|---|---|---|
| CN | 101685288 | 3/2010 |
| JP | 10048981 A | 2/1998 |
| JP | 2007057775 A | 3/2007 |

OTHER PUBLICATIONS

Machine translation of reference Mogi et al. (JP 2010-204,551 A), Pub date Sep. 16, 2010.*

(Continued)

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A fixing device includes a protected object disposed opposite an outer circumferential surface of a pressing rotary body and upstream from a fixing nip formed between the pressing rotary body and a fixing rotary body in a direction of rotation of the pressing rotary body; a stationary duct disposed upstream from the protected object in the direction of rotation of the pressing rotary body, the stationary duct including a blowoff outlet disposed opposite the outer circumferential surface of the pressing rotary body through which airflow impinges on the outer circumferential surface of the pressing rotary body; and a shield interposed between the blowoff outlet of the stationary duct and the protected object in the direction of rotation of the pressing rotary body to protect the protected object against airflow from the blowoff outlet.

14 Claims, 10 Drawing Sheets

(56) References Cited

U.S. PATENT DOCUMENTS

| | | | | |
|---|---|---|---|---|
| 2003/0053830 | A1 | 3/2003 | Hachisuka et al. | |
| 2003/0215270 | A1 | 11/2003 | Yamada | |
| 2005/0276638 | A1 | 12/2005 | Yamada | |
| 2006/0045590 | A1 | 3/2006 | Yamada | |
| 2008/0080909 | A1 | 4/2008 | Yamada | |
| 2009/0003897 | A1 | 1/2009 | Yamada | |
| 2009/0279908 | A1* | 11/2009 | Yoneda et al. | 399/33 |
| 2010/0074662 | A1 | 3/2010 | Hasegawa | |
| 2010/0189477 | A1 | 7/2010 | Yamada | |
| 2010/0226700 | A1 | 9/2010 | Yamada et al. | |
| 2010/0303523 | A1 | 12/2010 | Yamada | |
| 2011/0142480 | A1* | 6/2011 | Miyata et al. | 399/92 |
| 2011/0222874 | A1 | 9/2011 | Yamada | |
| 2011/0222881 | A1 | 9/2011 | Yamada | |
| 2011/0229201 | A1 | 9/2011 | Yamada | |
| 2012/0082491 | A1 | 4/2012 | Yamada | |
| 2012/0269532 | A1* | 10/2012 | Watanabe | 399/69 |

OTHER PUBLICATIONS

Abstract of JP 10-048981 published Feb. 20, 1998.
Abstract of JP 2007-057775 published Mar. 8, 2007.
Chinese Office Action mailed Feb. 12, 2014.

* cited by examiner

PRESSING STATE

NON-PRESSING STATE

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-047509, filed on Mar. 4, 2011, in the Japanese Patent Office, the entire disclosure of which is hereby incorporated herein by reference.

FIELD OF THE INVENTION

Example embodiments generally relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image, the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally; a fixing device applies heat and pressure to the recording medium bearing the toner image to fix the toner image on the recording medium, thus forming the image on the recording medium.

The fixing device used in such image forming apparatuses may employ a fixing roller heated by a heater and a pressing roller pressed against the fixing roller to form a fixing nip therebetween through which the recording medium bearing the unfixed toner image is conveyed. As the recording medium passes through the fixing nip in a state in which the front side of the recording medium that bears the unfixed toner image contacts the fixing roller, the fixing roller heated by the heater and the pressing roller apply heat and pressure to the recording medium, thus melting and fixing the toner image on the recording medium. In duplex printing, the recording medium is reversed after it is discharged from the fixing device and then conveyed through the fixing nip again in a state in which the back side of the recording medium that bears the unfixed toner image contacts the fixing roller and the front side of the recording medium that bears the fixed toner image contacts the pressing roller. Thus, the fixing roller and the pressing roller fix the toner image on the back side of the recording medium.

In duplex printing, it is important to prevent overheating of the pressing roller, which may cause failures described below. For example, if the surface temperature of the pressing roller is excessively higher than the surface temperature of the fixing roller, the gloss level of the toner image formed on the front side of the recording medium may be different from the gloss level of the toner image formed on the back side of the recording medium, minute scratches on the surface of the pressing roller may damage the toner image formed on the recording medium, or the recording medium may not separate from the pressing roller readily when it is discharged from the fixing nip. These failures are conspicuous when glossy paper or coated paper in increasing demand is used as the recording medium.

To address this circumstance, the fixing device may incorporate a fan that produces airflow inside a housing of the fixing device, which blows air on the surface of the pressing roller to cool it. However, airflow may also impinge on a temperature detector that should be protected against airflow to detect the surface temperature of the pressing roller precisely, resulting in erroneous detection and malfunction of the temperature detector.

Alternatively, the fan may blow air on the pressing roller through a duct. However, air discharged from an outlet of the duct may be directed to the temperature detector by the pressing roller upon impingement on the pressing roller, resulting in erroneous detection and malfunction of the temperature detector.

SUMMARY OF THE INVENTION

At least one embodiment may provide a fixing device that includes a fixing rotary body rotatable in a predetermined direction of rotation; a fixing rotary body heater disposed opposite the fixing rotary body to heat the fixing rotary body; and a pressing rotary body rotatable in a direction counter to the direction of rotation of the fixing rotary body. The pressing rotary body is separatably pressed against the fixing rotary body to form a fixing nip therebetween through which a recording medium bearing an unfixed toner image is conveyed in a state in which an image side of the recording medium that bears the unfixed toner image contacts an outer circumferential surface of the fixing rotary body and a non-image side of the recording medium that does not bear the unfixed toner image contacts an outer circumferential surface of the pressing rotary body. A protected object is disposed opposite the outer circumferential surface of the pressing rotary body and upstream from the fixing nip in the direction of rotation of the pressing rotary body. A stationary duct is disposed upstream from the protected object in the direction of rotation of the pressing rotary body. The stationary duct includes a blowoff outlet disposed opposite the outer circumferential surface of the pressing rotary body through which airflow impinges on the outer circumferential surface of the pressing rotary body. A shield is interposed between the blowoff outlet of the stationary duct and the protected object in the direction of rotation of the pressing rotary body to protect the protected object against airflow from the blowoff outlet.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
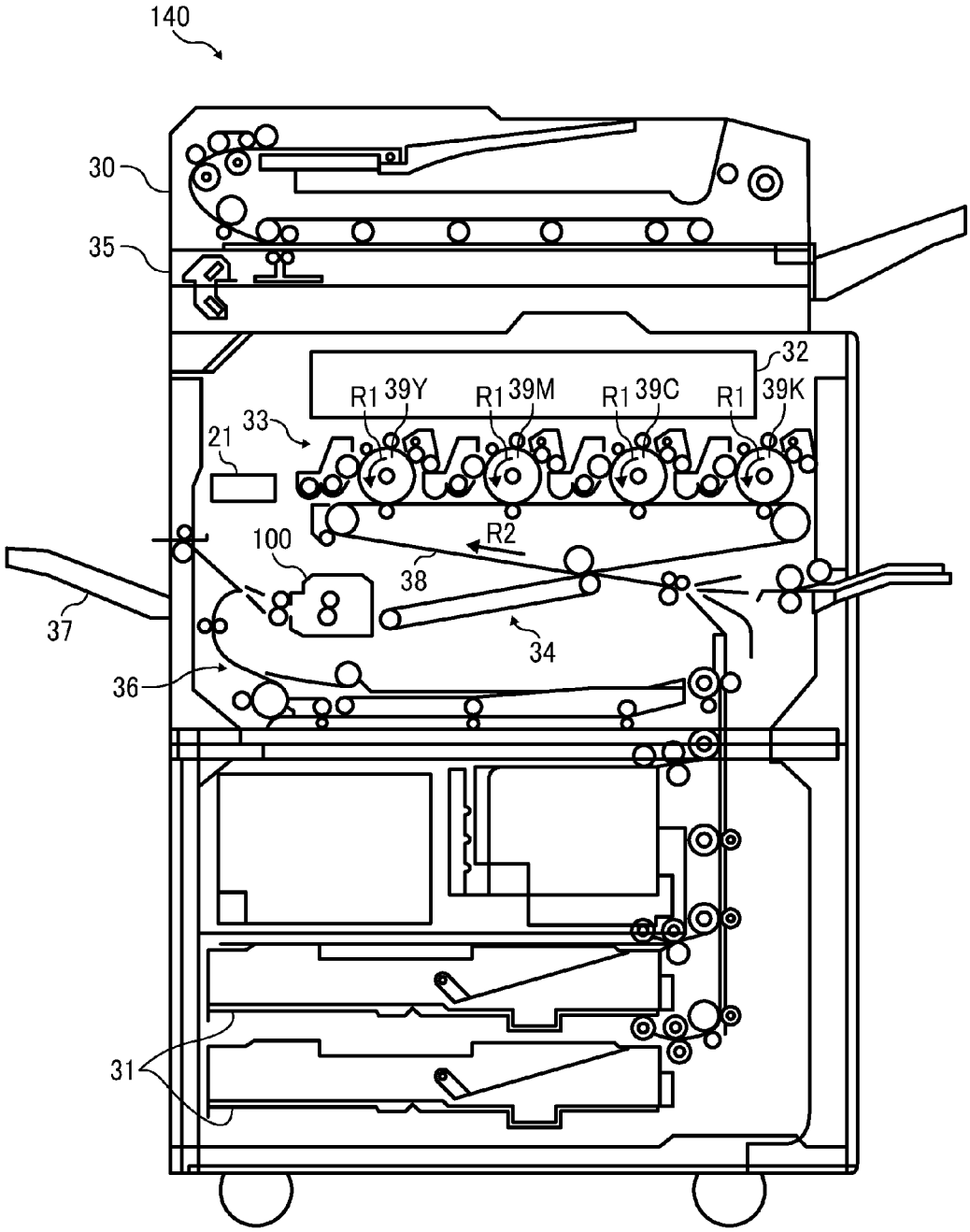
FIG. 1 is a schematic vertical sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 140 according to an example embodiment is explained.

FIG. 1 is a schematic sectional view of the image forming apparatus 140. The image forming apparatus 140 may be a copier, a facsimile machine, a printer, a multifunction printer having at least one of copying, printing, scanning, plotter, and facsimile functions, or the like. According to this example embodiment, the image forming apparatus 140 is a color copier for forming color and monochrome images on a recording medium by electrophotography.

The image forming apparatus 140 includes an auto document feeder (ADF) 30 disposed atop the image forming apparatus 140; a reader 35 disposed below the ADF 30; a writer 32 disposed below the reader 35; an image forming device 33 disposed below the writer 32 and including photoconductors 39Y, 39M, 39C, and 39K; a transfer device 34 disposed below the image forming device 33 and including a transfer belt 38; a fixing device 100 disposed below the transfer device 34; a duplex unit 36 disposed below the fixing device 100; a plurality of paper trays 31 disposed below the duplex unit 36 in a lower portion of the image forming apparatus 140, each of which loads a plurality of recording media (e.g., sheets made of plain paper, coated paper, and glossy paper); and an output tray 37 attached to one side of the image forming apparatus 140.

A detailed description is now given of the structure and operation of the image forming apparatus 140 having the components described above.

The ADF 30 feeds an original document bearing an image to the reader 35. The reader 35 (e.g., a scanner) reads the image on the original document into yellow, magenta, cyan, and black image data and sends the image data to the writer 32.

The writer 32 emits laser beams onto a charged outer circumferential surface of the respective photoconductors 39Y 39M, 39C, and 39K rotating in a rotation direction R1 according to the yellow, magenta, cyan, and black image data, thus forming an electrostatic latent image on the respective photoconductors 39Y, 39M, 39C, and 39K. Alternatively, the writer 32 emits laser beams according to image data sent from an external device such as a. client computer.

Then, development devices disposed opposite the photoconductors 39Y, 39M, 39C, and 39K supply yellow, magenta, cyan, and black toners to the electrostatic latent images formed on the photoconductors 39Y, 39M, 39C, and 39K, thus rendering the electrostatic latent images visible as yellow, magenta, cyan, and black toner images, respectively. Thereafter, primary transfer rollers of the transfer unit 34 disposed opposite the photoconductors 39Y, 39M, 39C, and 39K primarily transfer the yellow, magenta, cyan, and black toner images onto the transfer belt 38 rotating in a rotation direction R2 in such a manner that the yellow, magenta, cyan, and black toner images are superimposed on the same position on the transfer belt 38, thus forming a color toner image on the transfer belt 38. On the other hand, a feed roller feeds a recording medium from one of the paper trays 31 to a registration roller pair. The registration roller pair feeds the recording medium to the transfer belt 38 at a time when a secondary transfer roller of the transfer unit 34 secondarily transfers the color toner image from the transfer belt 38 onto the recording medium.

Then, the recording medium bearing the color toner image is conveyed to the fixing device 100. The fixing device 100 applies heat and pressure to the recording medium, thus fixing the color toner image on the recording medium. Thereafter, the recording medium bearing the fixed toner image is discharged onto the output tray 37.

Alternatively, if a duplex printing mode for forming a toner image on both sides (e.g., front and back sides) of the recording medium is selected by a user, the recording medium bearing the fixed toner image is conveyed to the duplex unit 36 that reverses the recording medium and sends it to the transfer device 34. The transfer device 34 transfers another color toner image from the transfer belt 38 onto the back side of the recording medium Thereafter, the recording medium bearing the toner image on both sides thereof is conveyed to the fixing device 100, and then discharged onto the output tray 37.

Figure 2:
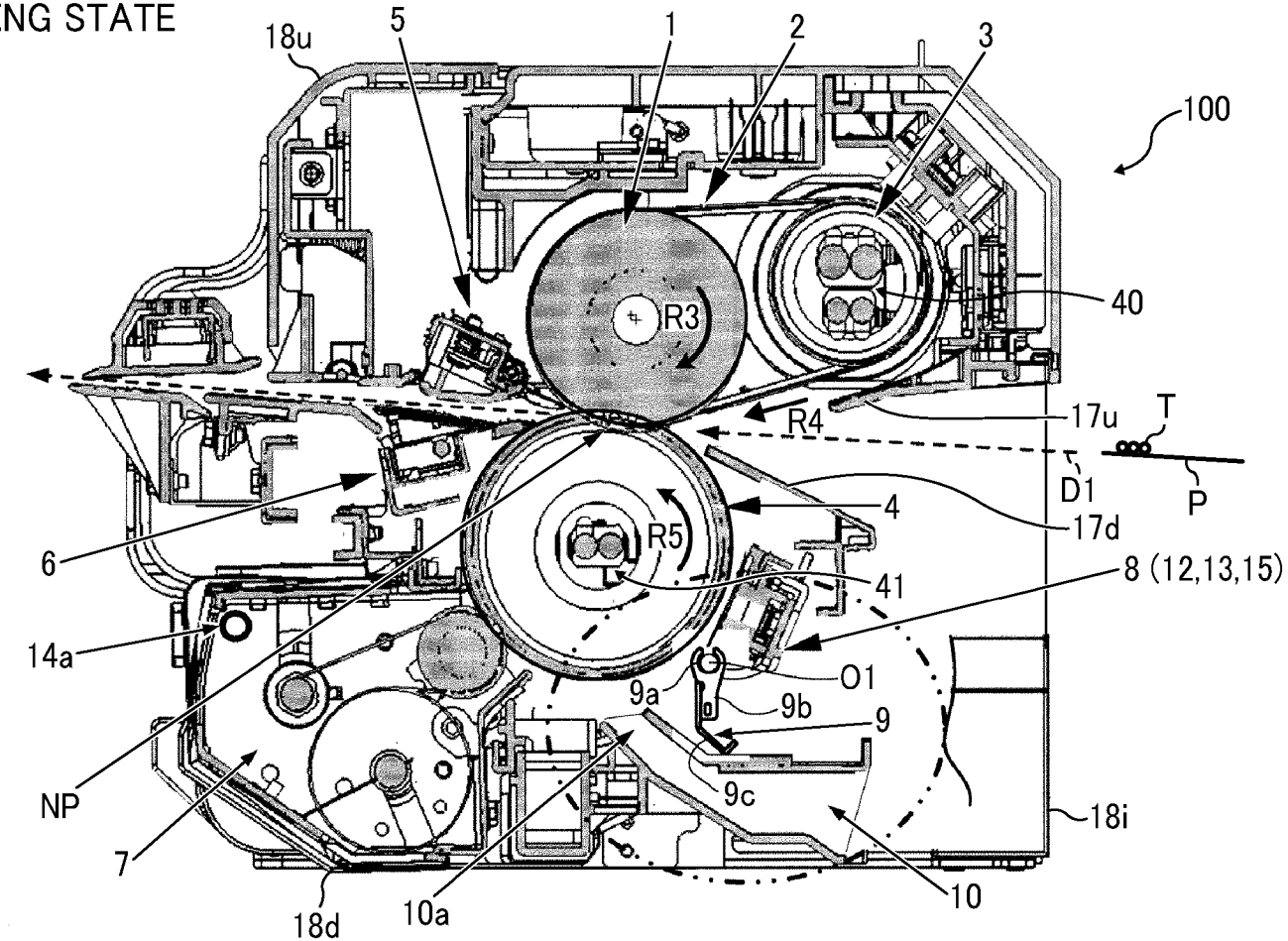
FIG. 2 is a vertical sectional view of a fixing device installed in the image forming apparatus shown in FIG. 1.

Referring to FIG. 2, the following describes the fixing device 100 incorporated in the image forming apparatus 140 described above.

FIG. 2 is a vertical sectional view of the fixing device 100. As shown in FIG. 2, the fixing device 100 (e.g., a fuser unit) includes a fixing belt 2, serving as a fixing rotary body, stretched over a fixing roller 1 and a heating roller 3; a pressing roller 4, serving as a pressing rotary body, pressed against the fixing roller 1 via the fixing belt 2 to form a fixing nip NP between the pressing roller 4 and the fixing belt 2; a halogen heater 40, serving as a heat source or a fixing rotary body heater, disposed inside the heating roller 3; a halogen heater 41, serving as a heat source or a pressing rotary body heater, disposed inside the pressing roller 4; an upper guide 17*u* and a lower guide 17*d* disposed upstream from the fixing nip NP in a recording medium conveyance direction D1 in which a recording medium P bearing a toner image T is conveyed; a fixing separation unit 5 and a pressing separation unit 6 disposed downstream from the fixing nip NP in the recording medium conveyance direction D1; and a cleaning web unit 7, protected objects 8, a shield 9, and a duct 10 disposed opposite the pressing roller 4. FIG. 2 illustrates a pressing state in which the pressing roller 4 is pressed against the fixing roller 1 via the fixing belt 2.

The upper guide 17*u* and the lower guide 17*d* guide a recording medium P bearing an unfixed toner image T to the fixing nip NP through a conveyance path shown in the arrow D1. The fixing roller 1 rotates in a rotation direction R3, which in turn rotates the fixing belt 2 in a rotation direction R4. The rotating fixing belt 2 rotates the pressing roller 4 in a rotation direction R5 due to friction therebetween. Alternatively, the pressing roller 4 rotating in the rotation direction R5 may rotate the fixing belt 2 in the rotation direction R4 due to friction therebetween. As the recording medium P is conveyed through the fixing nip NP, the fixing belt 2 heated by the halogen heater 40 via the heating roller 3 and the pressing roller 4 heated by the halogen heater 41 apply heat and pressure to the recording medium P, thus melting and fixing the toner image T on the recording medium P.

According to this example embodiment shown in FIG. 2, the fixing belt 2 serves as a fixing rotary body and the pressing roller 4 serves as a pressing rotary body. However, other configurations are available. A first example is that a pressing roller serving as a pressing rotary body is pressed against a fixing roller serving as a fixing rotary body to form a fixing nip therebetween. A second example is that a pressing belt stretched over a pressing roller and a heating roller is pressed against a fixing roller to form a fixing nip between the pressing roller and the fixing roller with the pressing belt interposed therebetween. A third example is that a pressing belt stretched over a pressing roller and a heating roller is pressed against a fixing belt stretched over a fixing roller and a heating roller to form a fixing nip between the pressing roller and the fixing roller with the pressing belt and the fixing belt interposed therebetween. That is, the fixing rotary body may be a fixing belt or a fixing roller and the pressing rotary body may be a pressing belt or a pressing roller.

According to this example embodiment shown in FIG. 2, as the recording medium P bearing the unfixed toner image T is conveyed through the fixing nip NP formed between the fixing belt 2 and the pressing roller 4 in a state in which an image side of the recording medium P that bears the unfixed toner image T contacts an outer circumferential surface of the fixing belt 2, the fixing belt 2 and the pressing roller 4 fix the toner image T on the recording medium P.

A detailed description is now given of the structure of the components incorporated in the fixing device 100.

The fixing belt 2 having an inner loop diameter of about 80 mm is constructed of a base layer having a thickness of about 90 micrometers and made of polyimide resin; an elastic layer having a thickness of about 200 micrometers and made of silicone rubber; and an outer surface layer having a thickness of about 20 micrometers and made of tetrafluoroethylene-perfluoroalkylvinylether copolymer (PFA).

The fixing belt 2 is looped over the fixing roller 1 having an outer diameter of about 54 mm and the heating roller 3 constructed of an aluminum hollow cylinder having an outer diameter of about 40 mm and a thickness not greater than about 1 mm. The fixing roller 1 having an outer diameter of about 54 mm is a cylinder constructed of a heat resistant elastic layer having a thickness of about 15 mm and made of silicone rubber or fluororubber.

The pressing roller 4 having an outer diameter of about 65 mm is constructed of a hollow metal core having a thickness of about 1.0 mm and made of steel; an elastic layer having a thickness of about 1.5 mm and made of silicone rubber; and an outer surface tube made of PEA. In the pressing state shown in FIG. 2 in which the pressing roller 4 is pressed against the fixing roller 1 via the fixing belt 2, the pressing roller 4 is engaged in the fixing roller 1 by about 4 mm, forming the fixing nip NP having a length of about 16 mm in the rotation direction R3 of the fixing roller 1.

Downstream from the fixing nip NP in the recording medium conveyance direction D1 is the pressing separation unit 6 (e.g., a plate assembly) disposed opposite the pressing roller 4 to separate the recording medium P discharged from the fixing nip NP from the pressing roller 4. Similarly, downstream from the fixing nip NP in the recording medium conveyance direction D1 is the fixing separation unit 5 (e.g., a plate assembly) disposed opposite the fixing belt 2 to separate the recording medium P discharged from the fixing nip NP from the fixing belt 2.

The recording medium P bearing the unfixed toner image T on the front side thereof is conveyed through the fixing nip NP in a state in which the unfixed toner image T on the front side of the recording medium P contacts the fixing belt 2. Conversely, the back side of the recording medium P that does not bear the unfixed toner image T contacts the pressing roller 4. Air taken in from an outside of the fixing device 100 through the duct 10 impinges on an outer circumferential surface of the pressing roller 4 through a blowoff outlet 10*a* as airflow.

Disposed opposite the outer circumferential surface of the pressing roller 4 are the protected objects 8 including a thermostat 15 serving as an overheat protector that prevents overheating of the pressing roller 4 and a thermistor 12 and a non-contact temperature sensor 13 serving as temperature detectors that detect the temperature of the outer circumferential surface of the pressing roller 4. As shown in FIG. 2, the thermostat 15 is disposed downstream from the blowoff outlet 10*a* of the duct 10 in the rotation direction R5 of the pressing roller 4. A detailed description of the thermostat 15, the thermistor 12, and the non-contact temperature sensor 13 is deferred.

Figure 3:
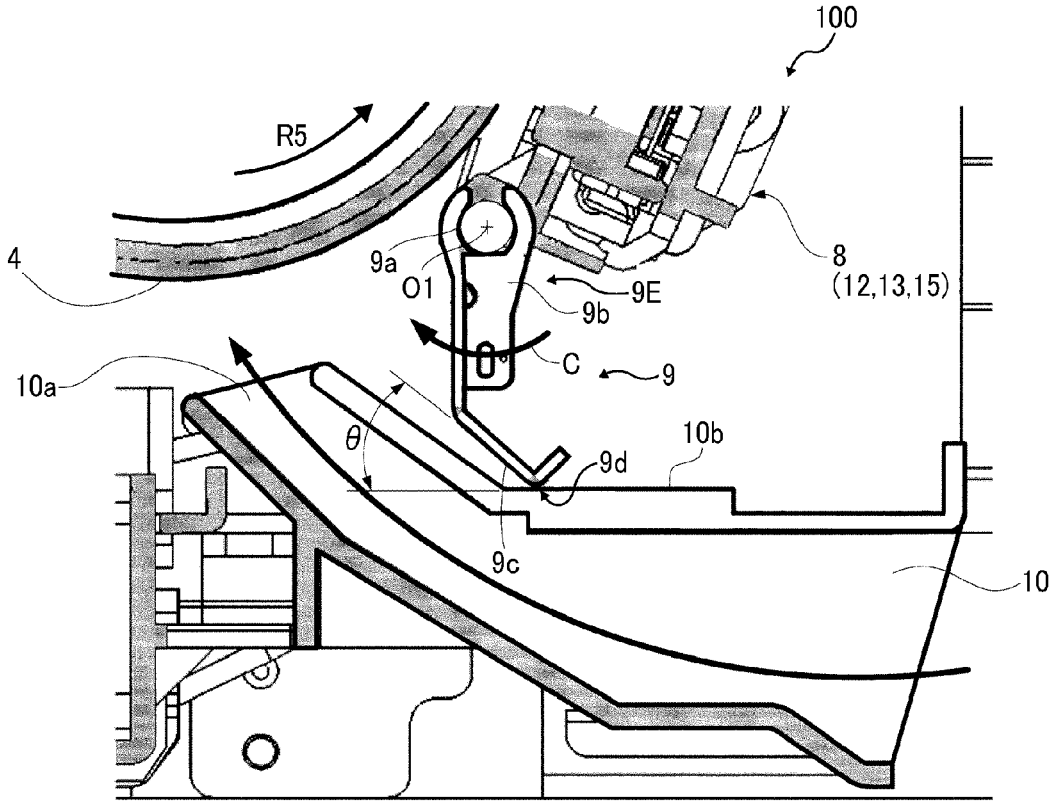
FIG. 3 is a partially enlarged vertical sectional view of the fixing device shown in FIG. 2.

FIG. 3 is a partially enlarged vertical sectional view of the fixing device 100 illustrating the components enclosed in the broken circle in FIG. 2 including the blowoff outlet 10*a*, the shield 9, the thermostat 15, the thermistor 12, and the non-contact temperature sensor 13. The shield 9 (e.g., a plate) is interposed between the blowoff outlet 10*a* and the thermostat 15 in the rotation direction R5 of the pressing roller 4 and in contact with the outer circumferential surface of the pressing roller 4, thus blocking airflow from the blowoff outlet 10*a*.

For example, one end of the shield 9 in a direction substantially orthogonal to the rotation direction R5 of the pressing roller 4 is disposed in proximity to the outer circumferential surface of the pressing roller 4; another end of the shield 9 in the direction substantially orthogonal to the rotation direction R5 of the pressing roller 4 contacts a top face 10*b* of the duct 10. The shield 9 shields the thermostat 15, the thermistor 12, and the non-contact temperature sensor 13 from the blowoff outlet 10*a*, blocking airflow blowing from the blowoff outlet 10*a* and protecting the thermostat 15, the thermistor 12, and the non-contact temperature sensor 13 against airflow from the blowoff outlet 10*a*.

With this configuration, air taken in from the outside of the fixing device 100 through the duct 10 impinges on the outer circumferential surface of the pressing roller 4, cooling the pressing roller 4. Accordingly, the pressing roller 4 does not overheat, preventing gloss differential between a gloss level of the toner image T on the front side of the recording medium and a gloss level of the toner image T on the back side of the recording medium P during duplex printing, which may arise due to overheating of the pressing roller 4. The cooled pressing roller 4 also prevents minute scratches on the outer circumferential surface of the pressing roller 4 from damaging the toner image T on the recording medium P. Further, the cooled pressing roller 4 prevents faulty separation of the recording medium P from the pressing roller 4 during duplex printing, which may arise due to overheating of the pressing roller 4. The shield 9 blocks airflow from the blowoff outlet 10*a*, preventing malfunction of the thermostat 15, the thermistor 12, and the non-contact temperature sensor 13.

Referring to FIGS. 4A to 7C, the following describes an upper fixing unit 100*u* and a lower fixing unit 100*d* of the fixing device 100.

Figure 4A:
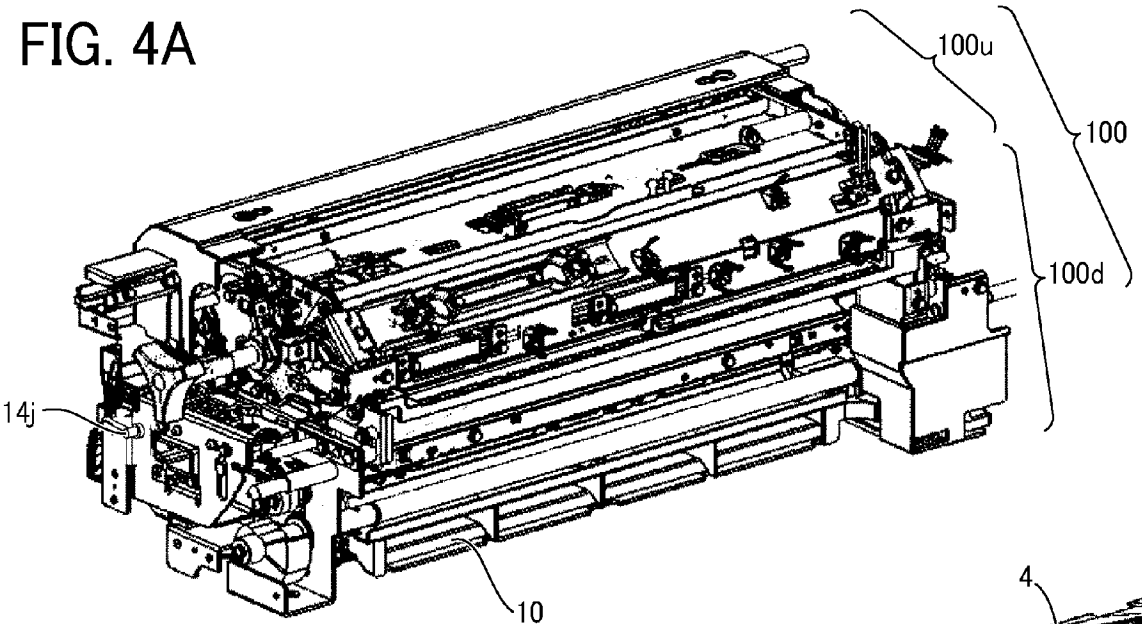
FIG. 4A is a perspective view of an upper fixing unit and a lower fixing unit incorporated in the fixing device shown in FIG. 2.
Figure 4B:
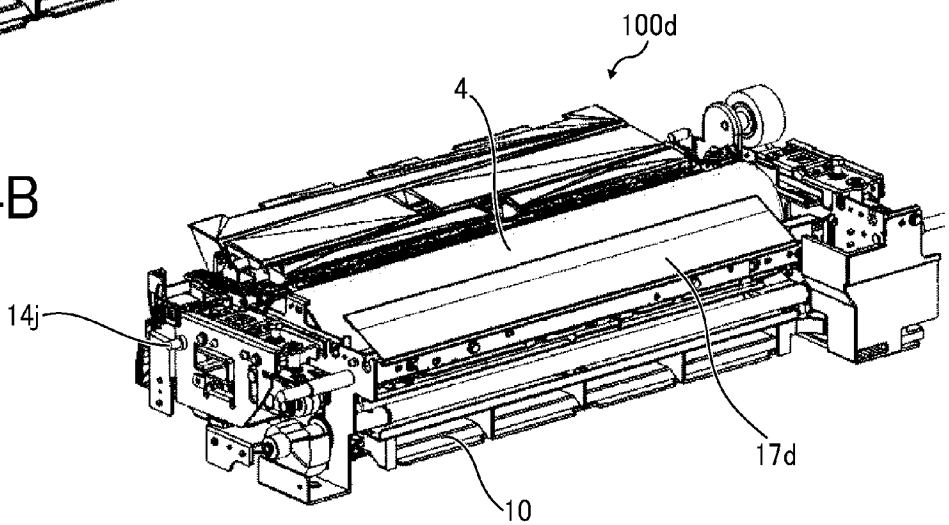
FIG. 4B is a perspective view of the lower fixing unit shown in FIG. 4A.
Figure 5:
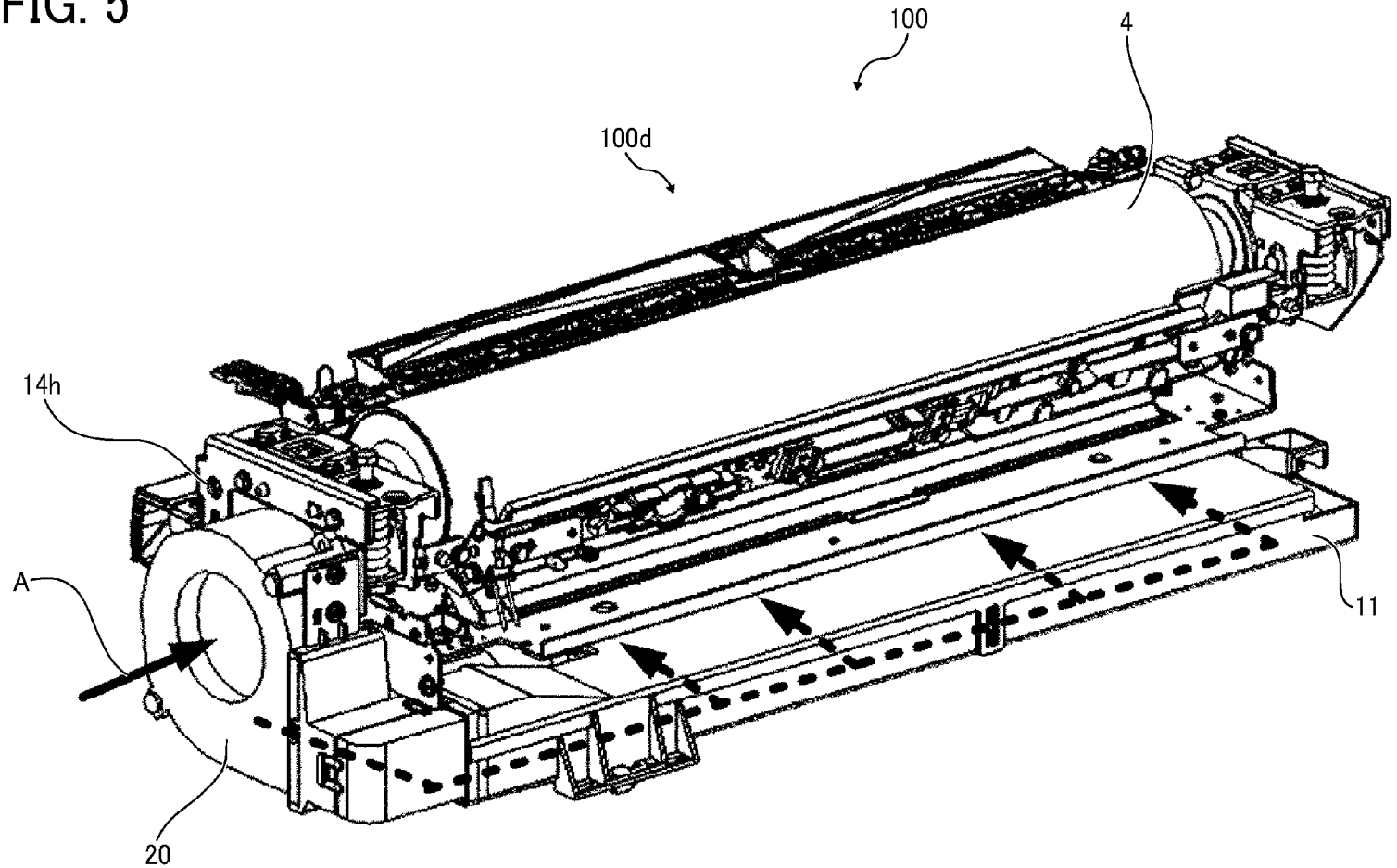
FIG. 5 is a perspective view of the lower fixing unit shown in FIG. 4B attached with a blower and an induction duct.
Figure 6A:
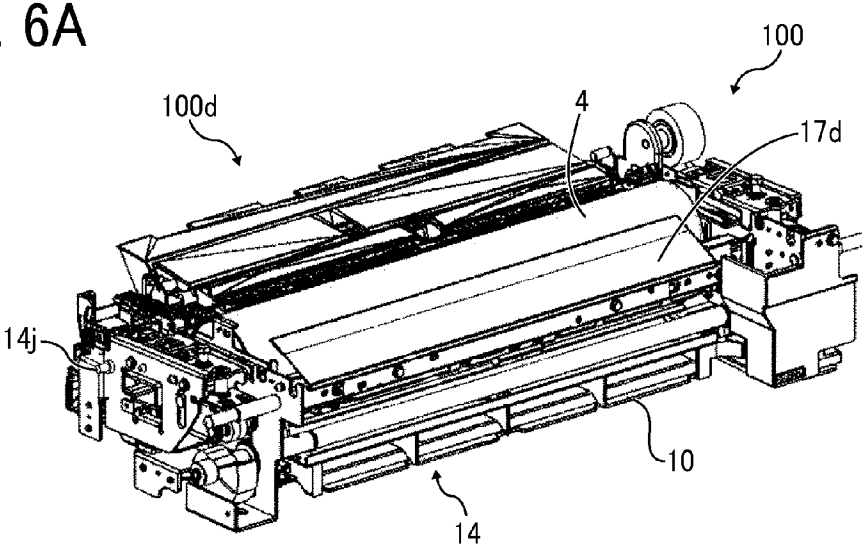
FIG. 6A is a perspective view of the lower fixing unit shown in FIG. 5 illustrating a pressing roller unit incorporated therein.
Figure 6B:
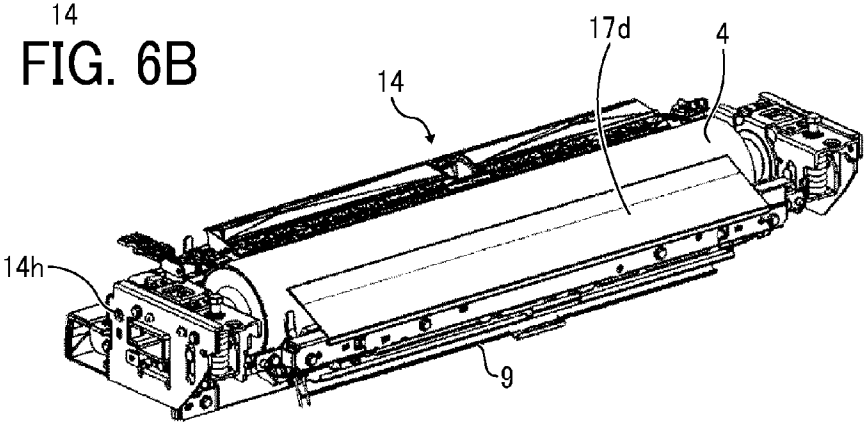
FIG. 6B is a perspective view of the pressing roller unit removed from the lower fixing unit shown in FIG. 6A.
Figure 6C:
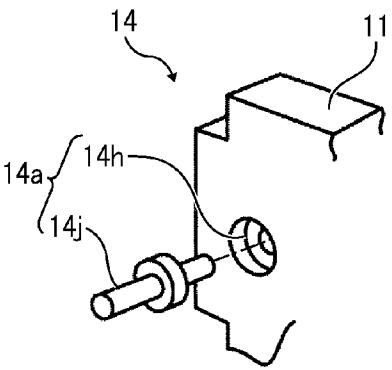
FIG. 6C is a partially enlarged perspective view of the pressing roller unit shown in FIG. 6B.
Figure 7A:
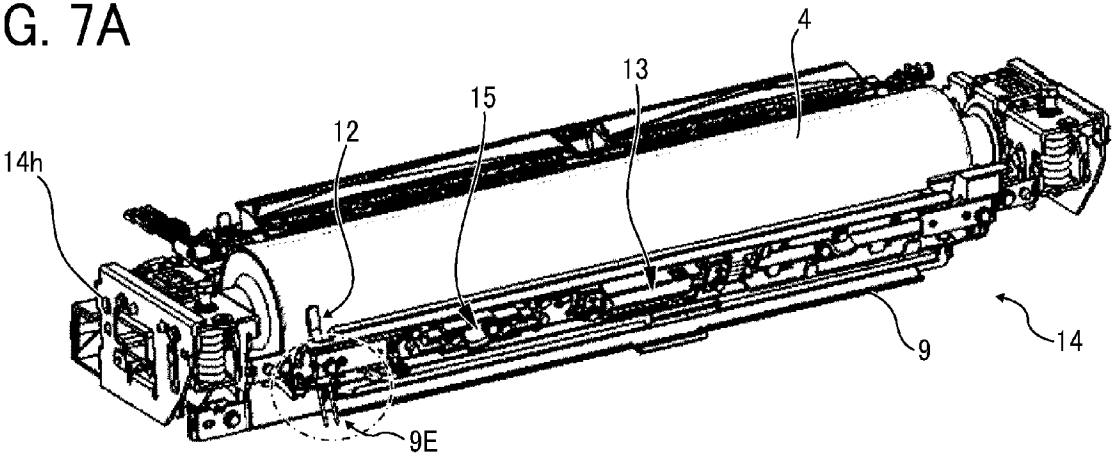
FIG. 7A is a perspective view of the pressing roller unit shown in FIG. 6B illustrating a base of a shield incorporated threrein.
Figure 7B:
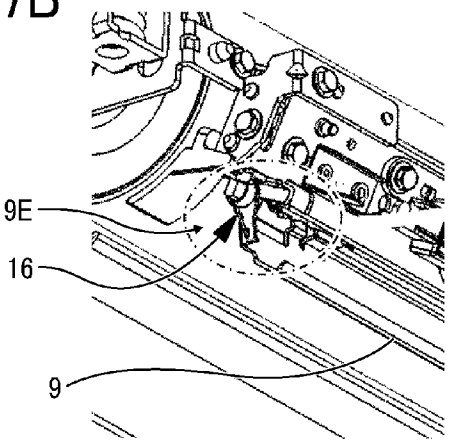
FIG. 7B is an enlarged perspective view of the base of the shield shown in FIG. 7A.
Figure 7C:
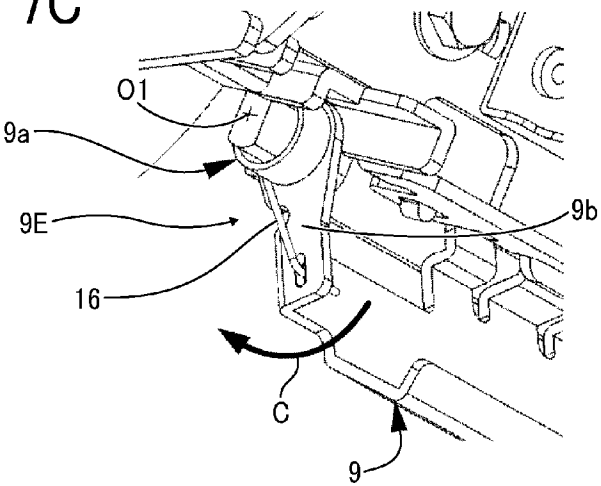
FIG. 7C is a further enlarged perspective view of the base of the shield shown in FIG. 7B.

FIG. 4A is a perspective view of the upper fixing unit 100*u* and the lower fixing unit 100*d* combined with each other. FIG. 4B is a perspective view of the lower fixing unit 100*d*. FIG. 5 is a perspective view of the lower fixing unit 100*d* attached with a blower 20 and an induction duct 11. FIG. 6A is a perspective view of the lower fixing unit 100*d* illustrating a pressing roller unit 14. FIG. 6B is a perspective view of the pressing roller unit 14 removed from the lower fixing unit 100*d* shown in FIG. 6A. FIG. 6C is a partially enlarged perspective view of the pressing roller unit 14. FIG. 7A is a perspective view of the pressing roller unit 14 illustrating a base 9E of the shield 9. FIG. 7B is an enlarged perspective view of the base 9E of the shield 9. FIG. 7C is a further enlarged perspective view of the base 9E of the shield 9.

The upper fixing unit 100*u* accommodates the fixing roller 1, the fixing belt 2, the heating roller 3, the halogen heater 40, the fixing separation unit 5, and other components attached to a stationary frame 18*u* as shown in FIG. 2. The lower fixing unit 100*d* accommodates the pressing roller 4, the pressing separation unit 6, the cleaning web unit 7, the thermistor 12, the non-contact temperature sensor 13, the thermostat 15, the shield 9, the duct 10, the halogen heater 41, and other components as shown in FIG. 2.

As shown in FIGS. 6A and 6B, the lower fixing unit 100*d* includes the pressing roller unit 14 accommodating at least the pressing roller 4, the halogen heater 41, the pressing separation unit 6, the cleaning web unit 7, the thermistor 12, the non-contact temperature sensor 13, the thermostat 15, and the shield 9 attached to a movable frame 18*d* as shown in FIG. 2. It is to be noted that the pressing roller unit 114 does not accommodate the duct 10. As shown in FIG. 6C, the pressing roller unit 14 is swingably supported by a support assembly 14*a* constructed of a shaft 14*j* and a through-hole 14*h*. Accordingly, the pressing roller 4, the halogen heater 41, the pressing separation unit 6, the cleaning web unit 7, the thermistor 12, the non-contact temperature sensor 13, the thermostat 15, and the shield 9 incorporated in the pressing roller unit 14 are swingable together as a unit within a range that allows contact and separation of the pressing roller 4 with respect to the fixing belt 2 so that the pressing roller 4 is pressed against and isolated from the fixing belt 2. That is, the pressing roller unit 14 is swingable with respect to the stationary duct 10 and the stationary upper fixing unit 100*u*.

As shown in FIG. 5, the fixing device 100 further includes the blower 20 and the induction duct 11 attached to the lower fixing unit 100*d*. The induction duct 11 guides airflow supplied from the blower 20 to the duct 10 depicted in FIG. 4B. According to this example embodiment, the blower 20 includes an axial fan. The blower 20 and the induction duct 11 are stationarily mounted on a stationary frame 18*i* of the fixing device 100 (depicted in FIG. 2) combined with a stationary frame of the image forming apparatus 140 depicted in FIG. 1. Therefore, unlike the swingable pressing roller unit 14 depicted in FIG. 6B, the blower 20 and the induction duct 11 are stationary and not swingable. The duct 10 connected with the induction duct 11 is also stationarily mounted on the stationary frame 18*i* of the fixing device 100. As shown in FIG. 5, air is taken in by the blower 20 in a direction A and then moves through a path shown in the broken line in FIG. 5 inside the induction duct 11 to the duct 10. Thereafter, air is discharged from the duct 10 through the blowoff outlet 10*a*, impinging on the outer circumferential surface of the pressing roller 4 as shown in FIG. 2.

As described above with reference to FIG. 6C, the pressing roller unit 14 is swingable about the support assembly 14*a*. The support assembly 14*a* constructed of the shaft 14*j* engaging the through-hole 14*h* is supported by a stationary member such as the stationary frame 18*i* of the fixing device 100 or the stationary frame of the image forming apparatus 140.

The pressing roller unit 14 moves to press the pressing roller 4 against the fixing belt 2 and separate the pressing roller 4 from the fixing belt 2. As shown in FIG. 7A, the pressing roller unit 114 includes the thermistor 12 disposed opposite one end of the pressing roller 4 in a longitudinal direction, that is, an axial direction, thereof, the non-contact temperature sensor 13 disposed opposite substantially a center of the pressing roller 4 in the axial direction thereof, and the thermostat 15 disposed opposite an intermediate portion of the pressing roller 4 interposed between the one end and the center of the pressing roller 4 in the axial direction thereof. The thermistor 12 and the non-contact temperature sensor 13 serve as temperature detectors that detect the temperature of the pressing roller 4. The thermostat 15 serves as an overheat protector that interrupts heating by the halogen heater 41 depicted in FIG. 2 to prevent overheating of the pressing roller 4.

According to this example embodiment, the thermistor 12, the non-contact temperature sensor 13, and the thermostat 15 serve as the protected objects 8 protected against airflow from the blowoff outlet 10*a* of the duct 10. Alternatively, a component other than the thermistor 12, the non-contact temperature sensor 13, and the thermostat 15 may be a protected object. Moreover, one or two of the thermistor 12, the non-contact temperature sensor 13, and the thermostat 15 may be a protected object.

As shown in FIGS. 3 and 7A, the base 9E of the shield 9 is disposed upstream from the thermistor 12, the non-contact temperature sensor 13, and the thermostat 15 and downstream from the blowoff outlet 10*a* of the duct 10 in the rotation direction R5 of the pressing roller 4. FIG. 7A illustrates the base 9E and its peripheral components enclosed in the broken line. FIG. 7B illustrates the enlarged base 9E. FIG. 7C illustrates the further enlarged base 9E.

As shown in FIG. 7C, the base 9E includes a support shaft 9*a* rotatably supported by a shield support of the pressing roller unit 14, a flange 9*b* attached to the support shaft 9*a*, and a torsion spring 16. The flange 9*b* is rotatable about a center axis O1 of the support shaft 9*a*. The torsion spring 16 exerts a rotation moment in a direction C on the flange 9*b*, thus rotating the shield 9 in the direction C. As shown in FIG. 3, rotation of the shield 9 in the direction C is stopped by the top face 10*b* of the duct 10 as a bent portion 9*d* of a free end 9*c* of the shield 9 contacts the top face 10*b* of the duct 10.

Figure 8A:
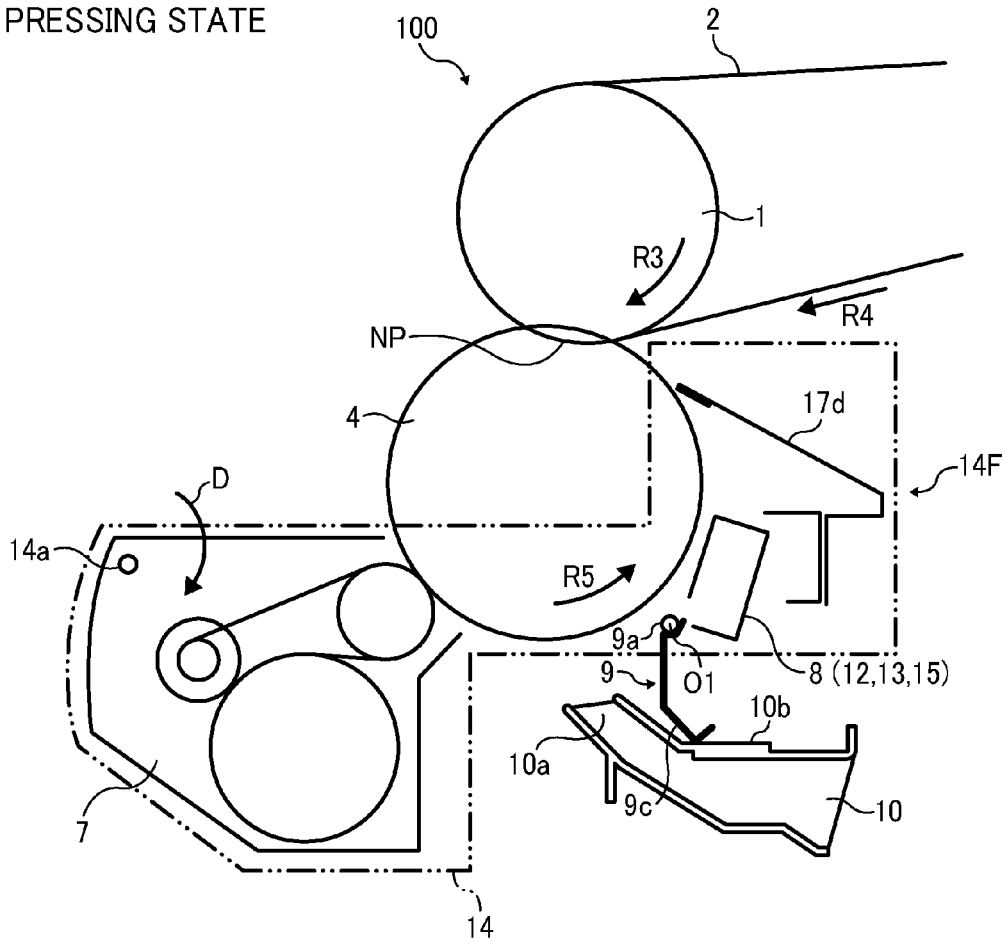
FIG. 8A is a schematic vertical sectional view of the fixing device shown in FIG. 2 in a pressing state.
Figure 8B:
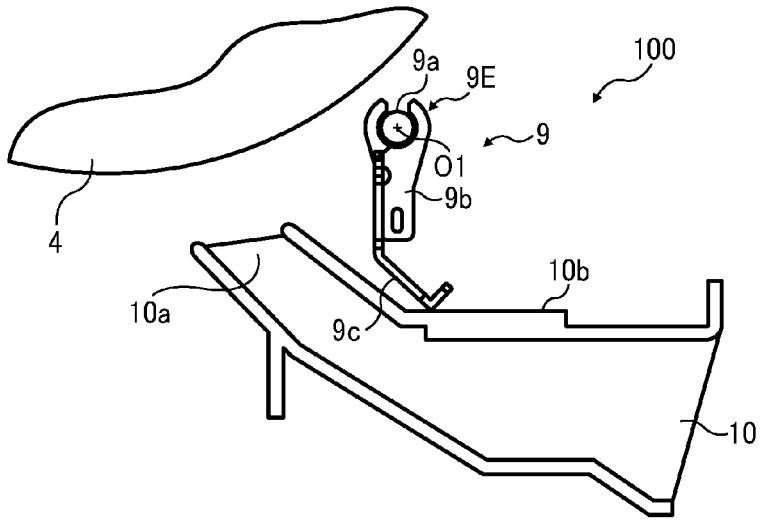
FIG. 8B is a partially enlarged schematic vertical sectional view of the fixing device shown in FIG. 8A illustrating the shield, a duct, and a pressing roller incorporated therein.

Referring to FIGS. 2, 3, 8A, and 8B, the following describes a pressing state of the fixing device 100 in which the pressing roller 4 is pressed against the fixing roller 1. FIG. 8A is a schematic vertical sectional view of the fixing device 100. FIG. 8B is a schematic vertical sectional view of the shield 9, the duct 10, and the pressing roller 4.

As shown in FIG. 8A, the support shaft 9*a* of the shield 9 is rotatably supported by the shield support, that is, a part of the movable frame 18*d*, of the pressing roller unit 14 depicted in FIG. 2. The thermostat 15, the thermistor 12, the non-contact temperature sensor 13, the shield 9, and the pressing roller 4 are supported by the movable frame 18*d* of the pressing roller unit 14 serving as a swing unit swingable about the shaft assembly 14*a* serving as a first shaft.

For example, as shown in FIG. 8B, the shield 9 includes the base 9E that incorporates the support shaft 9*a* serving as a second shaft disposed in proximity to the outer circumferential surface of the pressing roller 4. Thus, the shield 9 swings about the center axis O1 of the support shaft 9*a* rotatably supported by the movable frame 18*d* of the pressing roller unit 14 as the pressing roller unit 14 swings about the shaft assembly 14*a*. As shown in FIG. 3, the free end 9*c* of the shield 9 is tilted with respect to the top face 10*b* of the duct 10 by an angle θ. The top face 10*b* is integrated with the stationary frame 18*i* (depicted in FIG. 2) of the fixing device 100. The rotation moment produced by the torsion spring 16 depicted in FIG. 7C causes the free end 9*c* to contact the top face 10*b* of the duct 10.

As shown in FIG. 8A, the blowoff outlet 10*a* is disposed upstream from the shield 9 in the rotation direction R5 of the pressing roller 4; the protected objects 8 (e.g., the thermostat 15, the thermistor 12, and the non-contact temperature sensor 13) are disposed downstream from the shield 9 in the rotation direction R5 of the pressing roller 4. The shield 9 is interposed between the blowoff outlet 10*a* and the protected objects 8 in the rotation direction R5 of the pressing roller 4, protecting the protected objects 8 against airflow from the blowoff outlet 10*a*.

Referring to FIGS. 2, 3, 8A, 8B, 9A, 9B, 10A, and 10B, the following describes transition from the pressing state described above to a non-pressing state of the fixing device 100 in which the pressing roller 4 is isolated from the fixing roller 1 and the fixing belt 2.

Figure 9A:
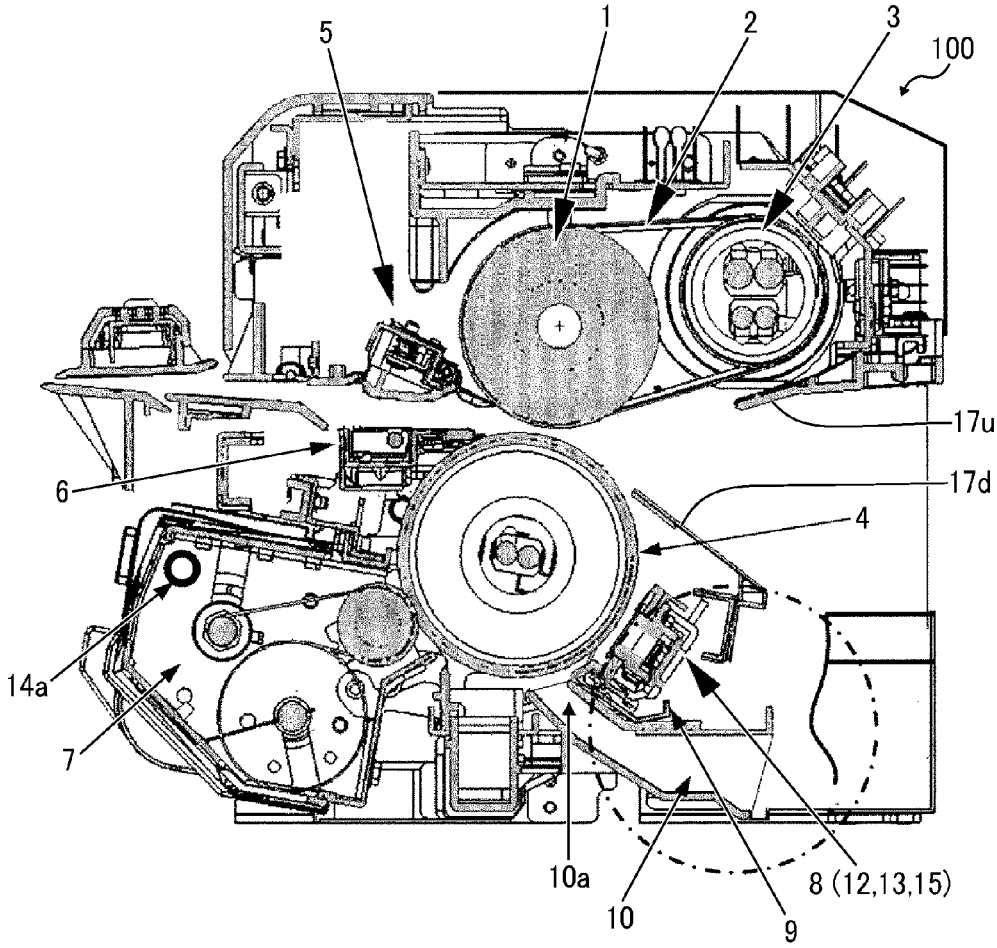
FIG. 9A is a vertical sectional view of the fixing device shown in FIG. 2 in a non-pressing state.
Figure 9B:
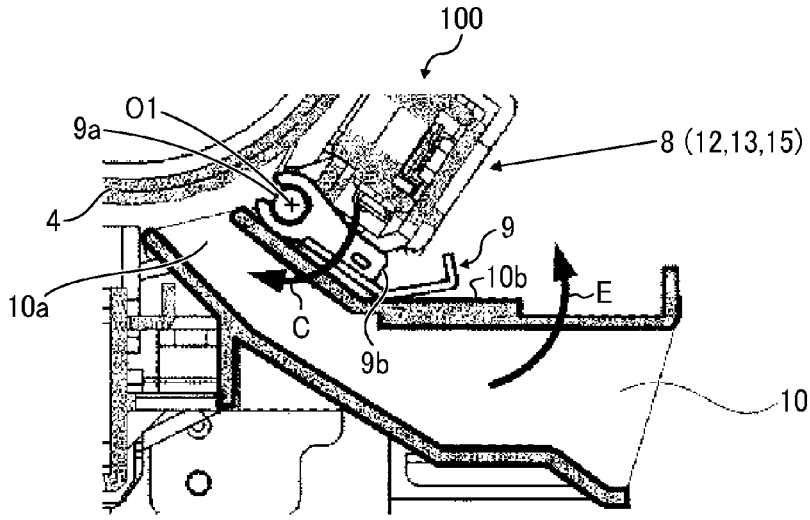
FIG. 9B is a partially enlarged vertical sectional view of the fixing device shown in FIG. 9A illustrating the shield, the duct, and the pressing roller incorporated therein.
Figure 10A:
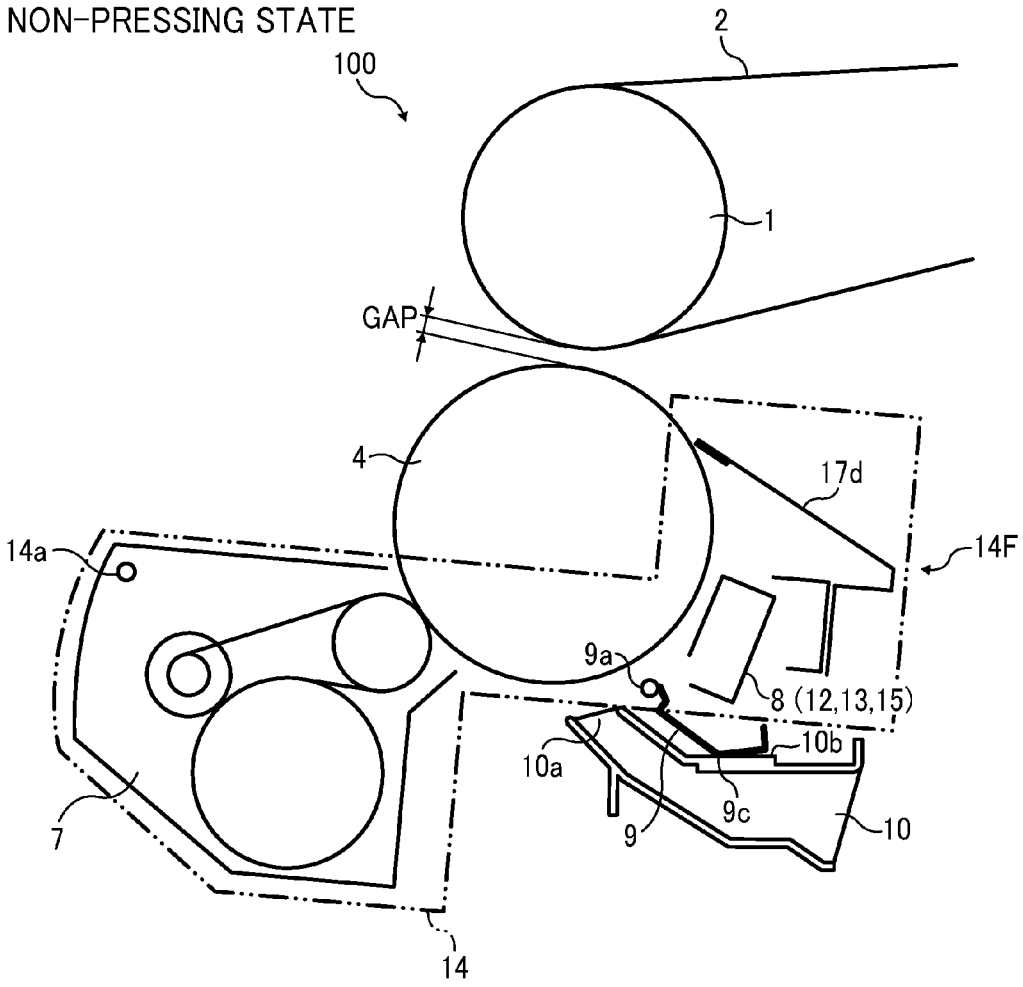
FIG. 10A is a schematic vertical sectional view of the fixing device shown in FIG. 9A.
Figure 10B:
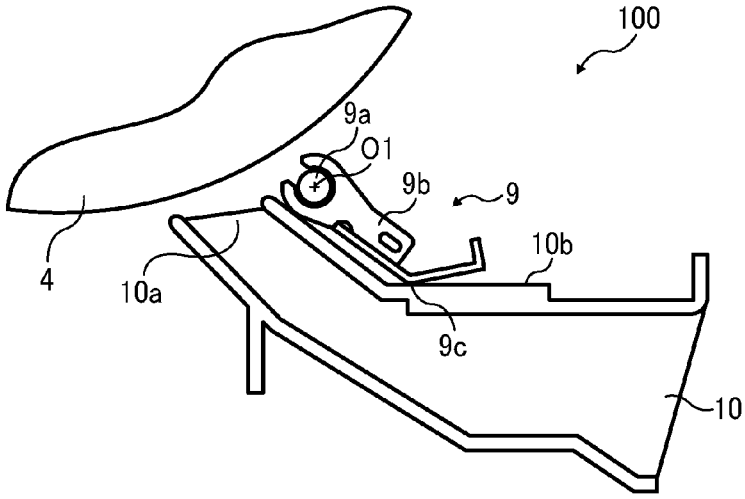
FIG. 10B is a partially enlarged schematic vertical sectional view of the fixing device shown in FIG. 10A illustrating the shield, the duct, and the pressing roller incorporated therein.

FIGS. 9A, 99, 10A, and 10B illustrate the non-pressing state of the fixing device 100. Specifically, FIG. 9A is a vertical sectional view of the fixing device 100. FIG. 9B is a vertical sectional view of the shield 9, the duct 10, and the pressing roller 4. FIG. 10A is a schematic vertical sectional view of the fixing device 100. FIG. 10B is a schematic vertical sectional view of the shield 9, the duct 10, and the pressing roller 4.

The pressing roller 4 is pressed against the fixing roller 1 as shown in FIGS. 2 and 8A while the recording medium P is conveyed through the fixing nip NP. By contrast, the pressing roller 4 is isolated from the fixing roller 1 and the fixing belt 2 as shown in FIGS. 9A and 10A while the recording medium P is not conveyed through the fixing nip NP because it is not necessary to press the pressing roller 4 against the fixing roller 1 via the fixing belt 2 and separation of the pressing roller 4 from the fixing roller 1 and the fixing belt 2 minimizes wear of the fixing roller 1 and the fixing belt 2. Like in the pressing state shown in FIGS. 2 and 8A, airflow is produced from the duct 10 also in the non-pressing state shown in FIGS. 9A and 10A.

To address this circumstance, the shield 9 remains interposed between the blowoff outlet 10*a* and the protected objects 8 (e.g., the thermostat 15, the thermistor 12, and the non-contact temperature sensor 13) even in the non-pressing state, thus protecting the protected objects 8 against airflow from the blowoff outlet 10*a*.

A cam assembly is connected to a free end 14F depicted in FIG. 8A of the pressing roller unit 14 to rotate the pressing roller unit 14 about the shaft assembly 14*a* serving as the first shaft in a given amount. After the recording medium P passes through the fixing nip NP, the cam assembly rotates the pressing roller unit 14 about the shaft assembly 14*a* clockwise in FIG. 8A in a rotation direction D. Accordingly, the pressing roller 4 separates from the fixing roller 1 and the fixing belt 2 in the non-pressing state as shown in FIG. 10A.

As the free end 14F of the pressing roller unit 14 rotates to separate the pressing roller 4 from the fixing roller 1 and the fixing belt 2 during transition from the pressing state to the non-pressing state, the free end 14F of the pressing roller unit 14 moves closer to the stationary duct 10. Accordingly, the shield 9 constituting the pressing roller unit 14 contacts the duct 10 and receives buckling stress. However, since the shield 9 is tilted with respect to the top face 10*b* of the duct 10 by the angle θ as shown in FIG. 3, white the shield 9 slides over the top face 10*b*, the shield 9 rotates about the center axis O1 of the support shaft 9*a* serving as the second shaft counterclockwise in FIG. 9B in a rotation direction E against the rotation moment exerted by the torsion spring 16 depicted in FIG. 7C.

As described above, in accordance with swinging of the pressing roller unit 14, while the shield 9 remains interposed between the blowoff outlet 10*a* and the protected objects 8 (e.g., the thermostat 15, the thermistor 12, and the non-contact temperature sensor 13) to protect the protected objects 8 against airflow from the blowoff outlet 10*a*, the shield 9 swings in such a manner that the free end 9*c* of the shield 9 slides over the top face 10*b* of the duct 10 as shown in FIGS. 8A and 10A. Simultaneously, the pressing roller 4 separates from the fixing roller 1 and the fixing belt 2 in the non-pressing state as shown in FIGS. 9A and 10A. Thereafter, the pressing roller unit 14 stops.

During transition from the pressing state to the non-pressing state as well as in the non-pressing state, the free end 9*c* of the shield 9 is constantly in contact with the top face 10*b* of the duct 10 by the rotation moment of the torsion spring 16, preventing air blowing from the blowoff outlet 10*a* from impinging on the thermostat 15, the thermistor 12, and the non-contact temperature sensor 13.

If the shield 9 is not configured to swing as described above, as the pressing roller unit 14 swings, the shield 9 may strike the duct 10 or may create clearance between the shield 9 and the duct 10, allowing air blowing from the duct 10 to move to the thermostat 15, the thermistor 12, and the non-contact temperature sensor 13.

To address this problem, both in the pressing state and the non-pressing state, the shield 9 interposed between the blowoff outlet 10*a* of the duct 10 and the protected objects 8 (e.g., the thermostat 15, the thermistor 12, and the non-contact temperature sensor 13) moves in accordance with movement of the pressing roller 4 while the shield 9 is constantly interposed between the blowoff outlet 10*a* and the protected objects 8 and in contact with the outer circumferential surface of the pressing roller 4. Accordingly, the shield 9 keeps blocking movement of air toward the protected objects 8. Consequently, the shield 9 prevents malfunction of the protected objects 8 both in the pressing state and the non-pressing state. Further, no extra sensors and motors are needed to move the shield 9 in accordance with movement of the pressing roller 4. That is, the simple configuration of the fixing device 100 described above is attained at reduced costs. Transition from the non-pressing state to the pressing state is performed with movement of the relevant components counter to the movement thereof described above.

As described above, as the pressing roller 4 is pressed against the fixing roller 1 via the fixing belt 2 and separates from the fixing belt 2, the protected objects 8 (e.g., the thermostat 15, the thermistor 12, and the non-contact temperature sensor 13) also move in accordance with movement of the pressing roller 4. Conversely, the duct 10, the fixing belt 2, and the fixing roller 1 are stationary. Accordingly, the distance between the blowoff outlet 10*a* and the outer circumferential surface of the pressing roller 4 changes in accordance with movement of the pressing roller 4. For example, when the pressing roller 4 is pressed against the fixing roller 1 via the fixing belt 2 in the pressing state, a greater distance is provided between the blowoff outlet 10*a* and the pressing roller 4 as shown in FIG. 2. By contrast, when the pressing roller 4 is isolated from the fixing roller 1 and the fixing belt 2, a smaller distance is provided between the blowoff outlet 10*a* and the pressing roller 4 as shown in FIG. 9A. Further, the positional relation between the blowoff outlet 10*a* and the protected objects 8 also changes in accordance with movement of the pressing roller 4. To address this circumstance, the shield 9 moves in accordance with movement of the pressing roller 4 while it is constantly interposed between the blowoff outlet 10*a* and the protected objects 8 and at the same time in contact with the outer circumferential surface of the pressing roller 4, thus protecting the protected objects 8 against airflow from the blowoff outlet 10*a*.

When at least one of the temperature detectors (e.g., the thermistor 12 and the non-contact temperature sensor 13) detects overheating of the pressing roller 4, the thermostat 15 interrupts power supply to the halogen heater 41 that heats the pressing roller 4, thus adjusting the temperature of the pressing roller 4. Accordingly, the temperature of the outer circumferential surface of the pressing roller 4 is maintained at a given temperature stably, minimizing gloss differential between a gloss level of the toner image T on the front side of the recording medium P and a gloss level of the toner image T on the back side of the recording medium P during duplex printing, which may arise due to overheating of the pressing roller 4. The adjustment of the temperature of pressing roller 4 also prevents minute scratches on the outer circumferential surface of the pressing roller 4 from damaging the toner image T on the recording medium P. Further, the adjustment of the temperature of the pressing roller 4 prevents faulty separation of the recording medium P from the pressing roller 4 during duplex printing, which may arise due to overheating of the pressing roller 4.

A controller 21 depicted in FIG. 1, that is, a central processing unit (CPU) provided with a random-access memory (RAM) and a read-only memory (ROM), for example, is operatively connected to the non-contact temperature sensor 13 depicted in FIG. 7A and the blower 20 depicted in FIG. 5. The controller 21 adjusts an amount of air supplied from the axial fan of the blower 20 according to an output of the non-contact temperature sensor 13 protected against airflow from the blowoff outlet 10*a* by the shield 9. Accordingly, the temperature of the outer circumferential surface of the pressing roller 4 is maintained at a given temperature stably, minimizing gloss differential between a gloss level of the toner image T on the front side of the recording medium P and a gloss level of the toner image T on the back side of the recording medium P during duplex printing, which may arise due to overheating of the pressing roller 4. The adjustment of the temperature of pressing roller 4 also prevents minute scratches on the outer circumferential surface of the pressing roller 4 from damaging the toner image T on the recording medium P. Further, the pressing roller 4 with the given temperature facilitates separation of the recording medium P from the pressing roller 4 during duplex printing.

The blower 20 depicted in FIG. 5 is connected to the pressing roller unit 14 depicted in FIG. 7A. The controller 21 may also adjust an amount of air supplied from the blower 20 according to an output of the thermistor 12 serving as a temperature detector disposed opposite one end of the pressing roller 4 in the axial direction thereof to detect the temperature of the one end of the pressing roller 4 as shown in FIG. 7A. If an amount of air supplied from the axial fan of the blower 20 is configured to be adjusted according to an output of the non-contact temperature sensor 13 disposed opposite the center of the pressing roller 4 in the axial direction thereof only, the temperature of the pressing roller 4 may not be adjusted precisely. For example, after a plurality of small recording media P is conveyed through the fixing nip NP continuously, the center of the pressing roller 4 may be cooled but lateral ends of the pressing roller 4 in the axial direction thereof may be overheated because the small recording media P do not pass over the lateral ends of the pressing roller 4 and therefore do not draw heat therefrom. To address this problem, an amount of air supplied from the axial fan of the blower 20 is adjusted according to an output of the thermistor 12 that detects the temperature of the one end of the pressing roller 4 in the axial direction thereof, thus minimizing overheating of the lateral ends of the pressing roller 4 which may arise after the plurality of small recording media P is conveyed through the fixing nip NP continuously.

The image forming apparatus 140 incorporating the fixing device 100 having the configuration described above improves stability in image forming, separation of the recording medium P from the pressing roller 4, and minimization of overheating of the pressing roller 4.

Referring to FIGS. 2, 3, 7A, 7C, 8A, and 9A, the following describes advantages of the fixing device 100 and the image forming apparatus 140 described above.

As shown in FIG. 2, the fixing device 100 includes a fixing rotary body (e.g., the fixing belt 2) rotatable in the rotation direction R4 and a pressing rotary body (e.g., the pressing roller 4) rotatable in the rotation direction R5 counter to the rotation direction R4 of the fixing rotary body and separatably pressed against the fixing rotary body to form the fixing nip NP therebetween. As a recording medium P bearing an unfixed toner image T is conveyed through the fixing nip NP to fix the toner image T on the recording medium P, an image side of the recording medium P bearing the unfixed toner image T contacts the fixing rotary body. Conversely, a non-image side of the recording medium P not bearing the unfixed toner image T contacts the pressing rotary body. Airflow supplied from the duct 10 through the blowoff outlet 10*a* impinges on an outer circumferential surface of the pressing rotary body. The blowoff outlet 10*a* and the protected objects 8 (e.g., the thermostat 15, the thermistor 12, and the non-contact temperature sensor 13) are disposed opposite the outer circumferential surface of the pressing rotary body with the shield 9 interposed between the blowoff outlet 10*a* and the protected objects 8 in the rotation direction R5 of the pressing rotary body. Thus, the shield 9 prohibits airflow from the blowoff outlet 10*a* from impinging on the protected objects 8, protecting the protected objects 8 against airflow.

The fixing rotary body heated by a heater (e.g., the halogen heater 40) may be a fixing roller or the fixing belt 2. The pressing rotary body heated by a heater (e.g., the halogen heater 41) may be the pressing roller 4 or a pressing belt.

The blower 20 depicted in FIG. 5, such as a fan, supplies air from the outside of the fixing device 100 to the pressing rotary body through the duct 10 in such a manner that airflow from the blowoff outlet 10*a* of the duct 10 impinges on the outer circumferential surface of the pressing rotary body. The protected objects 8, including at least one of the temperature detectors (e.g., the thermistor 12 and the non-contact temperature sensor 13) that detect the temperature of the outer circumferential surface of the pressing rotary body and an overheat protector (e.g., the thermostat 15 or a thermal fuse) that interrupts power supply to the heater heating the pressing rotary body when the pressing rotary body overheats, are disposed opposite the outer circumferential surface of the pressing rotary body. The shield 9 prohibits airflow from the blowoff outlet 10*a* from impinging on the protected objects 8. The overheat protector also interrupts power supply to the heater heating the pressing rotary body when the temperature detector and the pressing rotary body overheat.

With the configuration described above, airflow impinging on the outer circumferential surface of the pressing rotary body cools the pressing rotary body. Accordingly, the cooled pressing rotary body minimizes gloss differential between a gloss level of the toner image T on the front side of the recording medium P and a gloss level of the toner image T on the back side of the recording medium P during duplex printing, which may arise due to overheating of the pressing rotary body. The cooled pressing rotary body also prevents minute scratches on the outer circumferential surface of the pressing rotary body from damaging the toner image T on the recording medium P. Further, the cooled pressing rotary body facilitates separation of the recording medium P from the pressing rotary body during duplex printing, preventing adhesion of the recording medium P to the pressing rotary body, which may arise due to overheating of the pressing rotary body. Moreover, the shield 9 prohibits airflow from the blowoff outlet 10*a* from moving to the protected objects 8, preventing malfunction of the protected objects 8.

As shown in FIGS. 2 and 9A, as the pressing rotary body is pressed against the fixing rotary body and separates from the fixing rotary body, the protected objects 8 also move in accordance with movement of the pressing rotary body. Conversely, the duct 10 and the fixing rotary body are stationary. Accordingly, the distance between the blowoff outlet 10*a* of the duct 10 and the outer circumferential surface of the pressing rotary body changes in accordance with movement of the pressing rotary body. Further, the positional relation between the blowoff outlet 10*a* and the protected objects 8 also changes in accordance with movement of the pressing rotary body. To address this circumstance, the shield 9 moves in accordance with movement of the pressing rotary body while it remains interposed between the blowoff outlet 10*a* and the protected objects 8 and at the same time in contact with the outer circumferential surface of the pressing rotary body, thus protecting the protected objects 8 against airflow from the blowoff outlet 10*a*.

If the shield 9 is stationary, clearance may be created between the shield 9 and the pressing rotary body as the pressing rotary body moves, allowing airflow from the blowoff outlet 10*a* to move to the protected objects 8. To address this problem, the shield 9 moves in accordance with movement of the pressing rotary body and thus constantly prohibits airflow from the blowoff outlet 10*a* from moving to the protected objects 8, preventing malfunction of the protected objects 8 both in the pressing state in which the pressing rotary body is pressed against the fixing rotary body and in the non-pressing state in which the pressing rotary body is isolated from the fixing rotary body.

A swing unit (e.g., the pressing roller unit 14) depicted in FIGS. 7A and 8A swingable or rotatable about a first shaft (e.g., the shaft assembly 14*a*) accommodates the protected objects 8, the shield 9, and the pressing rotary body. As shown in FIG. 7C, the shield 9 includes the base 9E having a second shaft (e.g., the support shaft 9*a*) about which the shield 9 is swingable or rotatable. The second shaft is rotatably mounted on the swing unit and disposed in proximity to the outer circumferential surface of the pressing rotary body. As shown in FIG. 3, the shield 9 further includes the free end 9*c* that is in contact with the top face 10*b* serving as a slided face of the duct 10 integrally molded with the stationary frame 18*i* of the fixing device 100 and is tilted with respect to the top face 10*b*. As the swing unit swings, the shield 9 swings about the second shaft while the free end 9*c* of the shield 9 slides over the top face 10*b* of the duct 10. At the same time, the shield 9 remains interposed between the blowoff outlet 10*a* and the protected objects 8 and in contact with the outer circumferential surface of the pressing rotary body. Thus, the shield 9 blocks airflow from the blowoff outlet 10*a*.

As shown in FIG. 7C, the shield 9 is rotatable or swingable about the second shaft (e.g., the support shaft 9*a*). As a biasing member (e.g., the torsion spring 16) exerts a one-way rotation moment to the shield 9, a part of the shield 9, that is, the free end 9*c*, contacts the top face 10*b* of the duct 10 as shown in FIG. 3 and thus the shield 9 stops. As the pressing rotary body swings to press against and separate from the fixing rotary body, the second shaft (e.g., the support shaft 9*a*) of the shield 9 also moves in accordance with movement of the pressing rotary body. However, the shield 9 rotates while contacting the top face 10*b* of the duct 10 by the rotation moment exerted by the biasing member. Accordingly, both in the pressing state in which the pressing rotary body is pressed against the fixing rotary body and in the non-pressing state in which the pressing rotary body is isolated from the fixing rotary body, one side of the shield 9 faces the blowoff outlet 10*a* and an opposite side of the shield 9 faces the protected objects 8.

With this simple configuration of the shield 9 manufactured at reduced costs, the shield 9 moves in accordance with movement of the pressing rotary body so that the shield 9 is constantly interposed between the blowoff outlet 10*a* and the protected objects 8 while contacting the outer circumferential surface of the pressing rotary body both in the pressing state and the non-pressing state, thus prohibiting airflow from the blowoff outlet 10*a* from moving to the protected objects 8. Accordingly, the shield 9 prevents malfunction of the protected objects 8. The top face 10*b* constitutes a part of the duct 10, creating no clearance between the shield 9 and the duct 10 and thus shielding the protected objects 8 from airflow blowing from the blowoff outlet 10*a*. Further, the shield 9 allows airflow to effectively cool the pressing rotary body, preventing faulty separation of the recording medium P from the pressing rotary body, which may arise due to overheating of the pressing rotary body.

An amount of air supplied from the blower 20 is adjusted according to an output of the temperature detector serving as one of the protected objects 8, that is, one or both of the thermistor 12 and the non-contact temperature sensor 13. Accordingly, a desired amount of airflow from the blowoff outlet 10*a* impinges on the outer circumferential surface of the pressing rotary body. Consequently, the temperature of the outer circumferential surface of the pressing rotary body is maintained at a given temperature stably, minimizing gloss differential between a gloss level of the toner image T on the front side of the recording medium P and a gloss level of the toner image T on the back side of the recording medium P during duplex printing, which may arise due to overheating of the pressing rotary body. The adjustment of the temperature of the pressing rotary body also prevents minute scratches on the outer circumferential surface of the pressing rotary body from damaging the toner image T on the recording medium P. Further, the adjustment of the temperature of the pressing rotary body prevents faulty separation of the recording medium P from the pressing rotary body during duplex printing, which may arise due to overheating of the pressing rotary body.

As shown in FIG. 7A, the temperature detector includes the thermistor 12 disposed opposite one end of the pressing rotary body in an axial direction thereof to detect the temperature of the one end of the pressing rotary body and the non-contact temperature sensor 13 disposed opposite a center of the pressing rotary body in the axial direction thereof to detect the temperature of the center of the pressing rotary body.

If an amount of air supplied from the blower 20 that takes in air from the outside of the fixing device 100 is adjusted according to an output of the non-contact temperature sensor 13 that detects the temperature of the center of the pressing rotary body in the axial direction thereof only, after a plurality of small recording media P is conveyed through the fixing nip NP continuously, only the center of the pressing rotary body may be cool and lateral ends of the pressing rotary body in the axial direction thereof may overheat because the small recording media P do not draw heat from the lateral ends of the pressing rotary body in the axial direction thereof, and thereby the pressing rotary body may not be cooled entirely. To address this problem, an amount of air supplied from the blower 20 is adjusted according to an output of the thermistor 12 that detects the temperature of the one end of the pressing rotary body in the axial direction thereof. Accordingly, the lateral ends of the pressing rotary body, that are subject to overheat after the plurality of small recording media P is conveyed through the fixing nip NP continuously, can be cooled.

The image forming apparatus 140 incorporating the fixing device 100 described above improves stability in image forming, separation of the recording medium P from the pressing rotary body, and minimization of overheating of the pressing rotary body.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body rotatable in a predetermined direction of rotation;

a fixing rotary body heater disposed opposite the fixing rotary body to heat the fixing rotary body;

a pressing rotary body rotatable in a direction counter to the direction of rotation of the fixing rotary body and separatably pressed against the fixing rotary body to form a fixing nip therebetween through which a recording medium bearing an unfixed toner image is conveyed in a state in which an image side of the recording medium that bears the unfixed toner image contacts an outer circumferential surface of the fixing rotary body and a non-image side of the recording medium that does not bear the unfixed toner image contacts an outer circumferential surface of the pressing rotary body;

a protected object disposed opposite the outer circumferential surface of the pressing rotary body and upstream from the fixing nip in the direction of rotation of the pressing rotary body;

a stationary duct disposed upstream from the protected object in the direction of rotation of the pressing rotary body, the stationary duct including a blowoff outlet disposed opposite the outer circumferential surface of the pressing rotary body through which airflow impinges on the outer circumferential surface of the pressing rotary body; and a shield interposed between the blowoff outlet of the stationary duct and the protected object in the direction of rotation of the pressing rotary body to protect the protected object against airflow from the blowoff outlet.

2. The fixing device according to claim 1, further comprising a swing unit accommodating the pressing rotary body, the protected object, and the shield and swingable to press the pressing rotary body against the fixing rotary body and separate the pressing rotary body from the fixing rotary body.

3. The fixing device according to claim 2, further comprising a first shaft contacting and supporting the swing unit, the first shaft about which the swing unit swings, wherein the shield includes:

a second shaft disposed in proximity to the outer circumferential surface of the pressing rotary body; and a free end swingable about the second shaft while constantly contacting a slided face of the stationary duct in such a manner that the free end is tilted with respect to the slided face of the stationary duct.

4. The fixing device according to claim 3, wherein the free end of the shield slides over the slided face of the stationary duct as the swing unit swings about the first shaft.

5. The fixing device according to claim 1, wherein the fixing rotary body includes one of a fixing belt and a fixing roller and the pressing rotary body includes one of a pressing belt and a pressing roller.

6. The fixing device according to claim 1, wherein the protected object includes at least one temperature detector that detects a temperature of the pressing rotary body.

7. The fixing device according to claim 6, further comprising a blower connected to the stationary duct to supply air to the stationary duct in an amount of air adjusted according to the temperature of the pressing rotary body detected by the temperature detector.

8. The fixing device according to claim 7, wherein the blower includes an axial fan.

9. The fixing device according to claim 6, wherein the temperature detector includes a non-contact temperature sensor disposed opposite a center of the outer circumferential surface of the pressing rotary body in an axial direction thereof.

10. The fixing device according to claim 9, wherein the temperature detector further includes a thermistor disposed opposite one end of the outer circumferential surface of the pressing rotary body in the axial direction thereof.

11. The fixing device according to claim 10, wherein the protected object further includes a thermostat interposed between the non-contact temperature sensor and the thermistor in the axial direction of the pressing rotary body.

12. The fixing device according to claim 11, further comprising a pressing rotary body heater disposed opposite the pressing rotary body to heat the pressing rotary body, wherein the thermostat interrupts power supply to the pressing rotary body heater when one of the non-contact temperature sensor and the thermistor detects overheating of the pressing rotary body.

13. The fixing device according to claim 12, wherein the pressing rotary body heater and the fixing rotary body heater include a halogen heater.

14. An image forming apparatus comprising the fixing device according to claim 1.

* * * * *